United States Patent [19]

Hansson

[11] Patent Number: 4,811,996

[45] Date of Patent: Mar. 14, 1989

[54] DECORATIVE DISPLAY AND STORAGE CASE

[76] Inventor: Maria Hansson, 331 Joan St., Ronkonkoma, N.Y. 11779

[21] Appl. No.: 195,432

[22] Filed: May 16, 1988

Related U.S. Application Data

[63] Continuation of Ser. No. 892,385, Jul. 31, 1986, abandoned.

[51] Int. Cl.[4] ..... B65D 1/24

[52] U.S. Cl. ..... 312/132; 206/566; 248/220.3; 312/210; 312/227; 312/312

[58] Field of Search ..... 312/114, 119, 122, 126, 312/132, 193, 312, 213, 210, 224, 225, 226, 227; 248/220.3, 220.4, 221.1, 221.2, 224.4; 206/566; 211/163, 13, 105.1, 123

[56] References Cited

U.S. PATENT DOCUMENTS

| | | | |
|---|---|---|---|
| 806,566 | 12/1905 | Peters et al. | 312/122 |
| 1,767,745 | 6/1930 | Day | 248/220.4 X |
| 1,831,847 | 11/1931 | Derman | 312/227 |
| 2,617,217 | 11/1952 | Behr | 312/227 X |
| 2,739,697 | 3/1956 | Kuddes | 206/566 X |
| 3,813,138 | 5/1974 | Doohan | 312/309 |
| 4,123,128 | 10/1978 | Abele | 312/132 X |
| 4,181,224 | 1/1980 | Aber | 211/13 X |
| 4,396,121 | 8/1983 | Lemmon | 206/566 |
| 4,420,084 | 12/1983 | Whelan | 211/13 X |
| 4,606,458 | 8/1986 | LaBate | 206/566 |

FOREIGN PATENT DOCUMENTS

| | | | |
|---|---|---|---|
| 2653176 | 5/1978 | Fed. Rep. of Germany | 312/227 |
| 85316 | 6/1920 | Switzerland | 312/126 |

*Primary Examiner*—Peter A. Aschenbrenner
*Assistant Examiner*—Thomas A. Rendos
*Attorney, Agent, or Firm*—Parmelee, Bollinger & Bramblett

[57] ABSTRACT

A decorative display and storage case for attractively displaying and protectively storing earrings of the type for pierced ears has a base and an enclosure formed by four upstanding walls with at least one of the walls being transparent for permitting viewing of the contents of the enclosure. A plurality of display frames having plastic mesh screens positioned therein which screens have openings adapted to accommodate the wire prong element of earrings for pierced ears are mounted in the enclosure in aligned slots in two of the walls which are in a face-to-face relationship. The slots slidably receive and retain the display frames until the frames are slidably removed therefrom. A cover is positioned on top of the walls for closing the case. A mirror may be mounted on the inside surface of the cover which when held at an angle provides the viewer with a different view of the frames in the case to aid the selection of the frame carrying the set of earrings desired. The case may also include convenient storage drawers and may be compartmentized to increase the number of display frames housed therein.

1 Claim, 5 Drawing Sheets

DECORATIVE DISPLAY AND STORAGE CASE

This is a continuation of co-pending application Ser. No. 892,385 filed on July 31, 1986, now abandoned.

BACKGROUND OF THE INVENTION

This invention relates to a decorative display and storage case for attractively displaying and protectively storing earrings of the type which are made for pierced ears.

Earrings for pierced ears are characterized by being attached to a pierced earlobe by a prong or pin element of wire having retainer means for keeping the prong in the pierced earlobe as contrasted with other types of earrings which are attached to the earlobe by a friction clip or a screw. In view of the different manner of attachment to the ear, different problems arise in displaying and/or storing earrings for pierced ears as contrasted with the others which may be slipped on or off of a display card or board. Storing or showing earrings for pierced ears in loose form is not desirable because they may be either damaged or lost when handled loosely, and further the loose form of showing the earrings to the customer or owner will not display the earrings in the form in which they will be worn unless the customer or owner tries on the earrings. Since the prong or pin must be fitted into holes through the earlobe, it is difficult to try on a large number of such earrings for pierced ears as well as being time consuming. Accordingly, it would be preferable to allow the customer or owner to view the earrings by storing and displaying them in the manner in which they will be worn so that at least some of the selection process may be made by easy viewing in order to limit the number of earrings which must be tried on for making the final selection.

SUMMARY OF THE INVENTION

Accordingly, it is an object of this invention to provide a decorative display and storage case for both attractively displaying as well as protectively storing earrings for pierced ears.

A further object of this invention is to provide a new and improved decorative display and storage case which is simple in construction and facilitates storing large numbers of earrings for pierced ears in a manner which will give the consumer or owner an idea of what the earrings will look like without having to try them on.

Still another object of this invention is to provide a new decorative display and storage case for attractively displaying and protecting earrings for pierced ears which permits viewing the earrings through portions of the case to enable ready location of the earrings which are desired to be viewed more closely or tried on by a consumer or owner.

In carrying out this invention in one illustrative embodiment thereof, a decorative display and storage case is provided having a base with four upstanding walls mounted thereon for forming a rectangular enclosure having at least one of those walls transparent for permitting viewing of at least part of the contents of the interior of the enclosure. A plurality of display frames having plastic mesh screens mounted therein which are adapted to receive the prong or pin elements of earrings for pierced ears are mounted in a plurality of aligned slots in opposed walls of the enclosure which slots slidably receive and retain the frames until slidably removed therefrom. A cover is positioned on top of the walls for opening and closing the enclosure thereby forming a display and storage case whereby the frame or frames carrying the earrings of interest may be quickly located through the transparent wall and easily removed from the case thereby providing a portable, attractive manner of storing and displaying earrings of the type for pierced ears.

BRIEF DESCRIPTION OF THE DRAWINGS

The invention, together with further features, aspects, advantages and objects thereof will be more clearly understood from the following description taken in connection with the accompanying drawings which are not necessarily to scale and in which like reference numerals are utilized to identify like elements.

DESCRIPTION OF THE PREFERRED EMBODIMENTS

Figure 1:
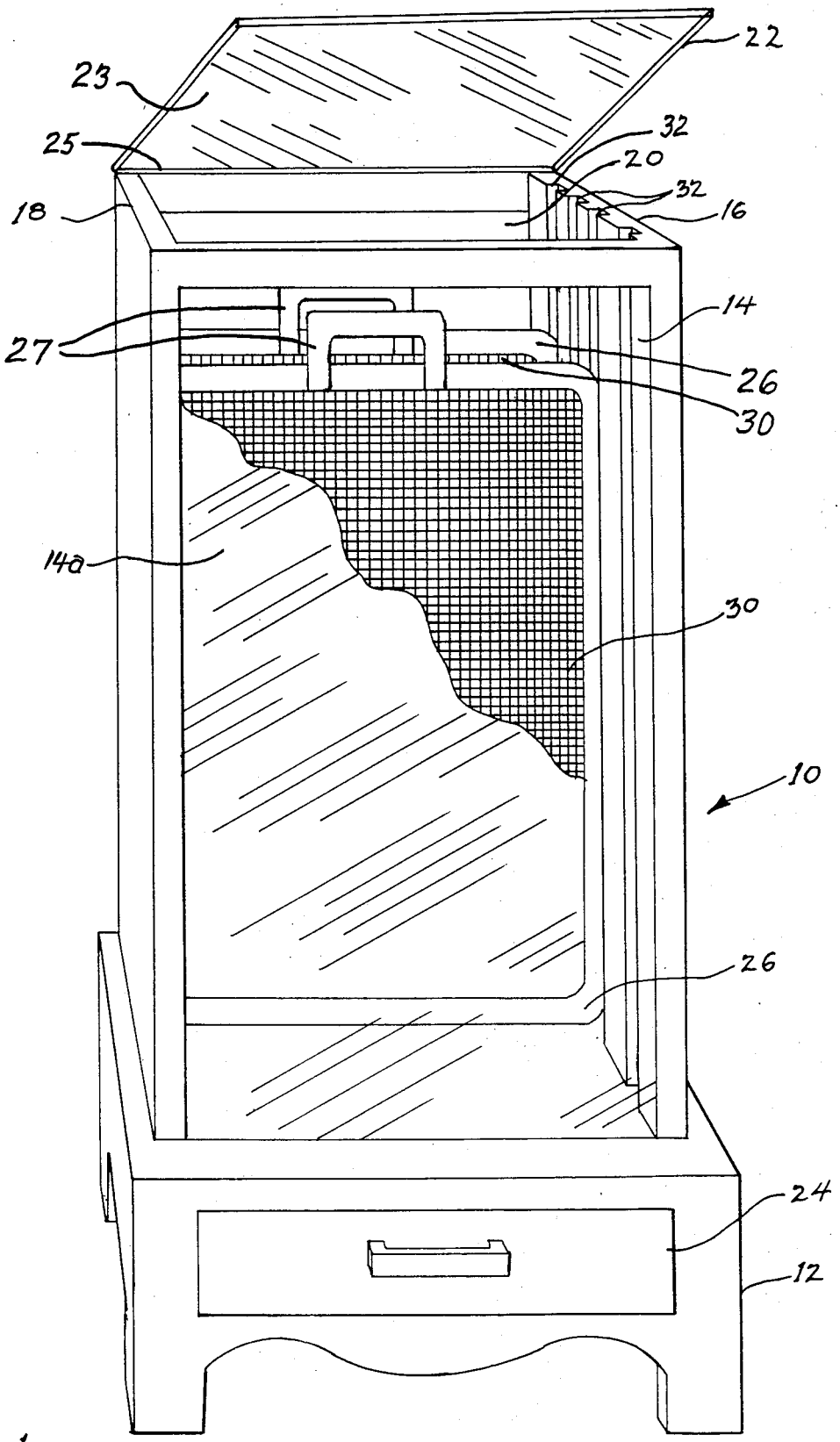
FIG. 1 is a front perspective view of one form of a decorative display and storage case for earrings for pierced ears in accordance with the present invention.
Figure 2:
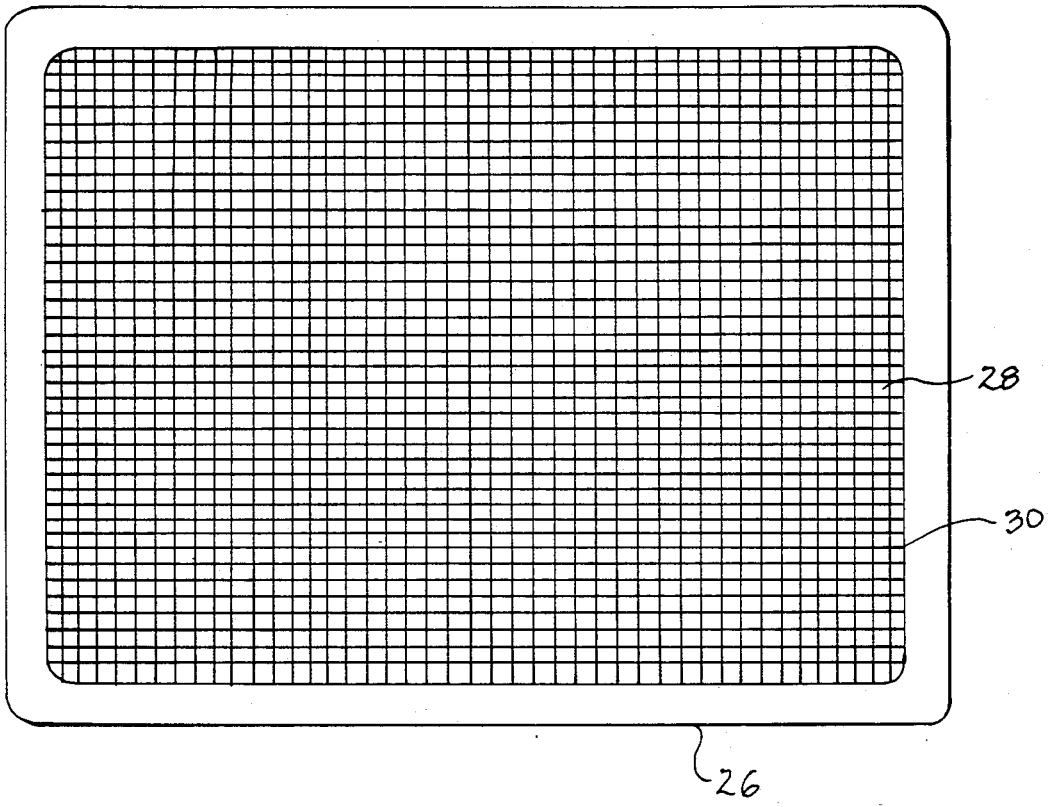
FIG. 2 is a front elevational view of a frame carrying a plastic mesh screen on which earrings for pierced ears are adapted to be mounted and which frame is used in the embodiment of FIG. 1 as well as the embodiments which follow.

Referring now to FIGS. 1 and 2, a decorative display and storage case, referred to generally with the reference numeral 10, includes a base 12 having four upstanding walls 14, 16, 18 and 20 mounted thereon forming a rectangular enclosure closed optionally by a cover 22 shown in phantom in FIG. 1. The base may include a storage drawer 24 for storing duplicate earrings of those being displayed in the display case.

As will be seen in FIG. 2, a display frame 26 encloses and has mounted therein a relatively rigid plastic mesh screen 30 having rectangular openings 28 therein which are adapted to receive the prong or pin element of earrings for pierced ears which are adapted to be mounted on the mesh screen 30 in the holes 28. The removable clamps or fasteners are slid in gripping relationship onto the tips of those elements behind the rear surface of the mounting screen for removably holding the earrings in place. The mesh screen 30 is preferrably plastic having square holes therein 1/16 of an inch in height and width. It is advantageous to have such small openings 28 about 1/16th of an inch in diameter for appropriately receiving and supporting the prong or pin portion of such earrings. There are numerous horizontal rows of these small openings 28 in each display screen 30 and each row includes numerous openings 28. The frame 26 is placed on or crimped onto the edges of each mesh screen 30 to provide rigidity for the mesh and to hold it neatly as a convenient display support and as a movable, handleable upright mounting background for earrings for pierced ears thereon. When the prong or pin element of an earring for pierced ears is placed through an opening 28 in the mesh and the spring clamp is attached thereto on the tip on this element behind the mesh the earring is displayed in the same manner in which it is attached to the earlobe of the user. Accordingly, the user may obtain some idea of the appearance of the earring on a user because of the manner in which it is mounted on the mesh 30. For convenience of the user in sliding upwardly or handling a selected display screen 30, it is preferred to have a handle or tab 27 on the top edge of each frame 26.

The frame 26 is adapted to be slidably mounted in the decorative display case 10 in a standing vertical position. Returning again to FIG. 1, walls 16 and 18 carry a plurality of aligned slots 32 (not seen in wall 18) which are adapted to slidably receive and hold the frame 26 with its associated mesh 30 as is illustrated in FIG. 1. Preferably, the walls 14, 20 as well as the cover 22 may be made of clear, transparent acrylic sheet in order to provide a viewable access to the frames and the earrings mounted thereon. The transparent walls aid in the selection process enabling the user to slide up the frame carrying the earrings which are desired to be inspected. The frame 26 is preferably of nickel-plated or chromium plated steel or similar bright and shiny strong, stiff, durable, wear-resistant material for sliding up and down in the slots 32 without showing abrasion and for stiffening the permimeter of the plastic mesh screen 30. The user can conveniently view the earrings through a transparent panel **14*a* in the front wall 14. For providing another angle of view for selecting a desired set of earrings on one of the display screens 30, there may be a mirror 23 mounted on the lower surface of cover 22 which is hinged to the back wall 20 by a piano hinge 25**.

Figure 3:
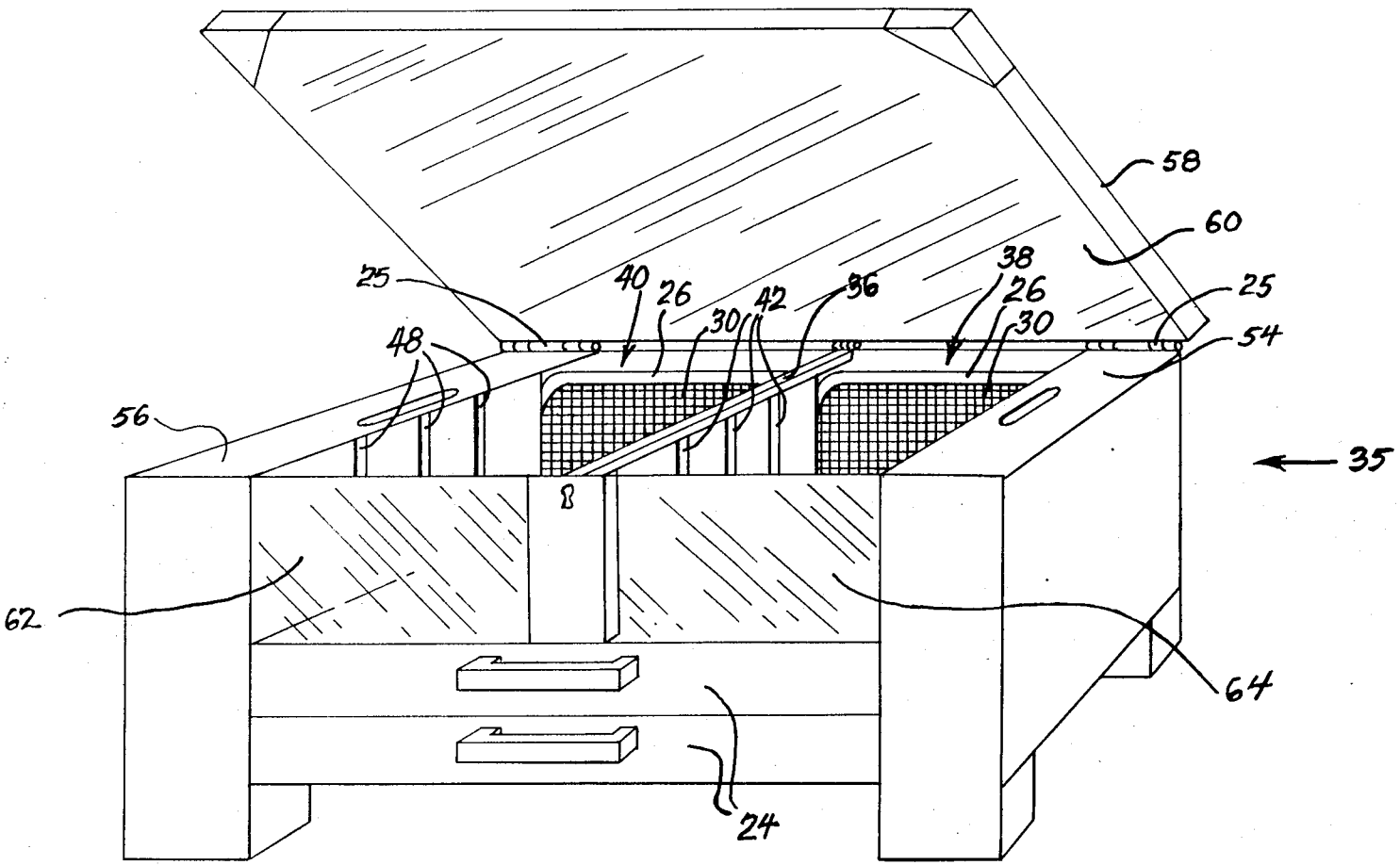
FIG. 3 a front perspective view of another embodiment of the decorative display and storage case for attractively displaying and protectively storing earrings for pierced ears which embodiment is divided into compartments.
Figure 4:
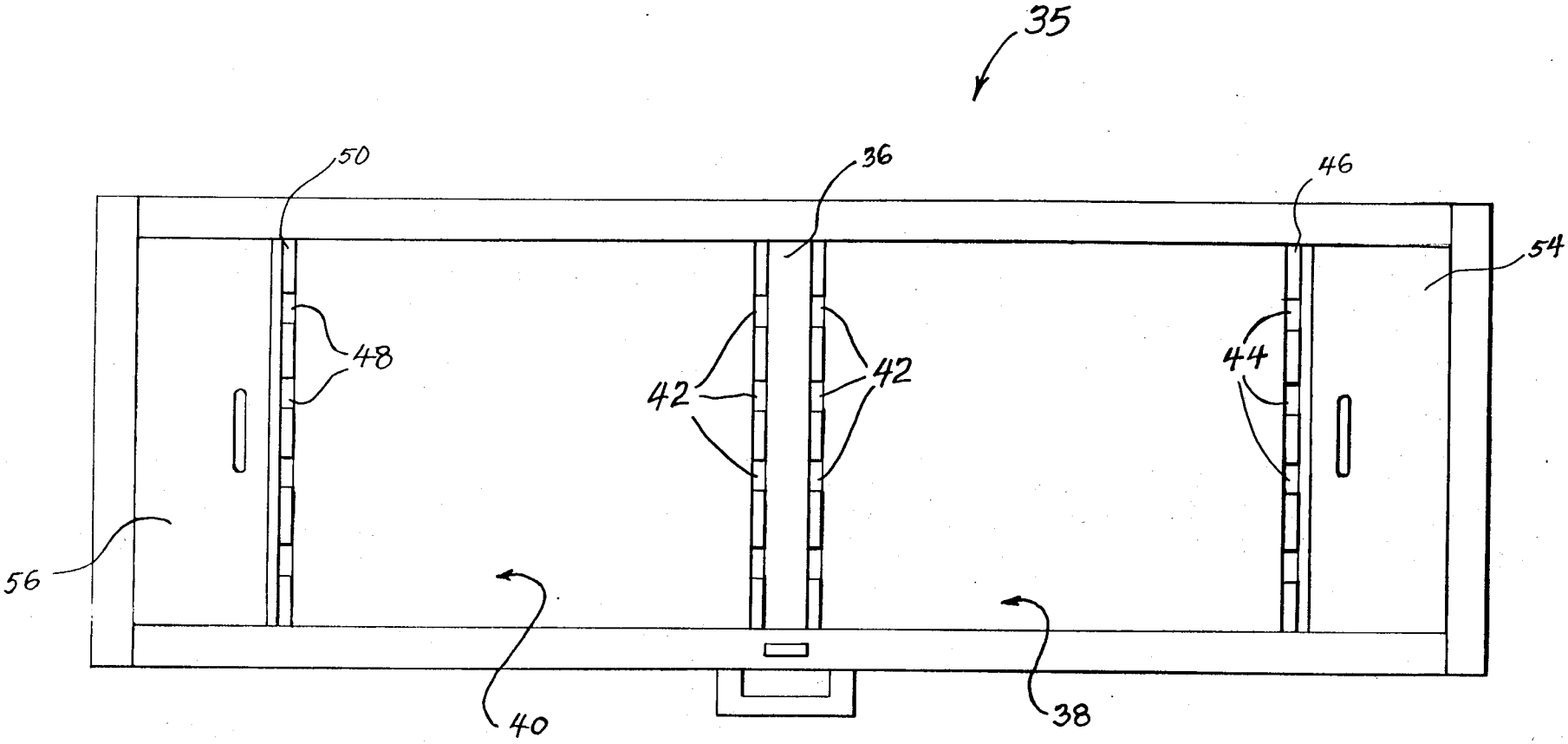
FIG. 4 is a top view of the embodiment of FIG. 3 with the cover removed.

FIG. 3 illustrates another embodiment of the present invention utilizing the same principles in which a decorative display and storage case, referred to generally with the reference numeral 35, is provided with a central partition 36 which divides the display case 35 into two compartments 38 and 40, as is most clearly seen in FIG. 4. In this embodiment, the partition 36 has a plurality of aligned slots 42 on both sides thereof which are aligned with slots 44 in sidewall 46 and slots 48 in sidewall 50. The aligned slots 42 and 44 accommodate the slidable receipt of frames 26 as do the aligned slots 42 and 48 thus increasing the number of frames 26 which may be accommodated in the case 35. Case 35 may also have storage drawers 24 as well as side storage compartments 54 and 56 with openable covers. The decorative storage case 35 includes a hinged cover 58 covered by a mirror 60 on the inside surface thereof which performs a dual function. In an open upright position the mirror serves as a means for the person trying on earrings to view those earrings in place. The mirror 60 can also be used by opening the cover at different angles which permits the user to view different aspects of the interior of the compartments 38 and 40 of the decorative case 35 in order to more quickly permit selection of the frame 26 carrying the earrings desired to be inspected and worn. The display case 35 also is characterized by having transparent windows 62 and 64 on the front of compartments 40 and 38, respectively, so as to make the contents of the compartment visible to the viewer.

Figure 5:
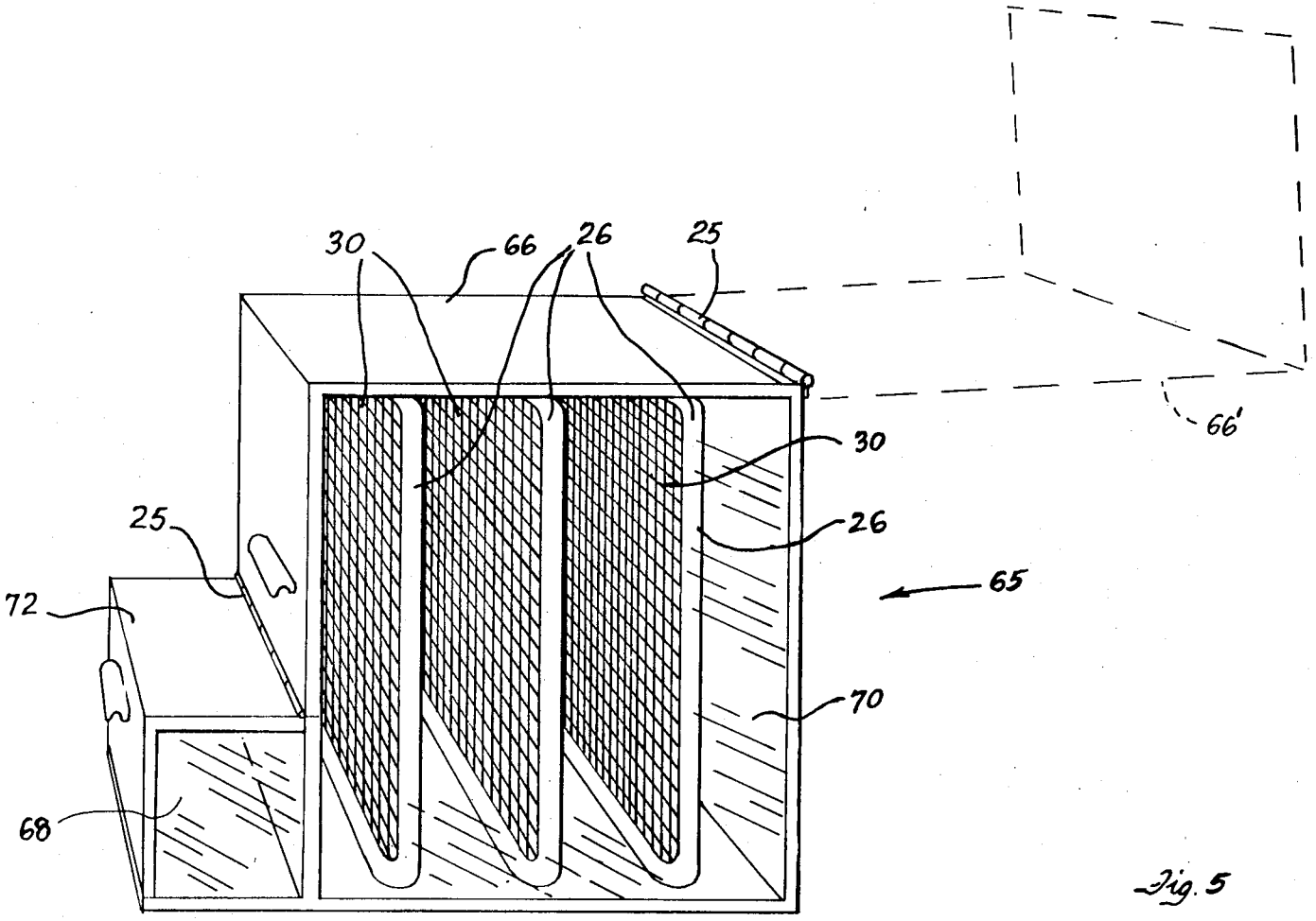
FIG. 5 is another embodiment of the decorative display and storage case in accordance with the present invention.

FIG. 5 is another embodiment of the decorative display case, referred to generally by reference numeral 65. This embodiment is characterized by folded cover 66 which is also illustrated in an open position 66' in phantom in FIG. 5. The decorative display case of this embodiment includes a storage compartment 68 and has transparent sidewalls 70 which are slotted to hold the frames 26 as well as to provide viewing of the interior to help in the selection of the frame with the earrings desired to be viewed. The side storage compartment 68 has a hinged cover 72.

The present invention is characterized by providing a very convenient, as well as a safe and protective means of displaying earrings for pierced ears which eliminate the possibility of losing earrings which may become separated when stored loosely or which prevent damage from loose storage simply by conveniently mounting the earrings on the mesh frame in the manner described in connection with the present invention. The earrings are totally enclosed and protected from dirt, and the plastic mesh does not absorb moisture thereby protecting the earrings from discoloration as well as other dust and contaminants. By displaying the earrings individually in sets in a manner in which they would be worn, namely mounted upright through an opening, limits the likelihood of theft since removal of the earrings from the frame would leave readily identifiable openings therein and might help identify the person who had tried on the earrings. By displaying the entire stock of pierced earrings, the selection process is made easier and the appearance of one set of earrings may be quickly compared with that of others of similar or different types which would be useful in the marketing of the earrings or selection by the owner. Accordingly, a decorative, convenient and efficient way is provided for both displaying, selling, storing and/or protecting earrings of the type utilized on pierced ears.

Since other changes and modifications varied to fit particular operating requirements and environments will be apparent to those skilled in the art, the invention is not considered limited to the examples chosen for purposes of illustration, and includes all changes and modifications which do not constitute a departure from the true spirit and scope of this invention as claimed in the following claims and equivalents thereto.

What is claimed is:

1. A decorative display and storage case for attractively displaying and protectively storing earrings for pierced ears comprising:

a base having a storage drawer therein, four upstanding walls mounted on said base and forming a rectangular enclosure upstanding on said base, one of the walls being a front wall having a transparent panel therein for permitting viewing of at least a part of the contents in the enclosure formed by said walls, a plurality of upstanding plastic mesh display screens each having numerous rows of numerous small openings therein of about 1/16th of an inch in diameter adapted to received therein the earlobe mounting element of earrings for pierced ears for convenient storage and display of such earrings, each of said mesh display screens having a handle thereon for facilitating the movement of the display screen with the earrings positioned thereon, two of the walls in face-to-face relationship having a plurality of upright opposed aligned slots, said slots being aligned in opposed pairs slidably receiving one of said display screens in each pair of said opposed aligned slots, a cover hinged on the top of one of said walls for opening and closing said enclosure, said hinged cover having a mirror mounted on the lower surface of said cover whereby positioning said mirror at different angles will provide the viewer with different views of the display screens in said case to aid in the selection of the display screen having the desired earrings supported thereon without having to remove all the display screens, said slots retaining until slidably removed therefrom a plurality of said display screens, said enclosure being divided into compartments by a center partition having upright slots on both sides thereof which slots are aligned with opposed slots in said two walls having said face-to-face relationship thereby increasing the number of display screens capable of being housed in said case, thereby forming a display and storage case whereby the display screen carrying the earrings of interest may be quickly located through said transparent wall and easily slid upwardly along the pair of slots in which said display screen is being removably stored in the case for providing a portable, attractive case and display screens for storing and/or displaying and handling such earrings.

* * * * *